US005717381A

United States Patent [19]

Jagielinski et al.

[11] Patent Number: 5,717,381

[45] Date of Patent: Feb. 10, 1998

[54] COPYRIGHT PROTECTION FOR PHOTOS AND DOCUMENTS USING MAGNETIC ELEMENTS

[75] Inventors: Tomasz Marek Jagielinski, Carlsbad; Frederick John Jeffers, Escondido; Jay Davis Freeman, Leucadia; Frederick Rockwell Chamberlain, IV, Vista, all of Calif.

[73] Assignee: Eastman Kodak Company, Rochester, N.Y.

[21] Appl. No.: 576,192

[22] Filed: Dec. 21, 1995

[51] Int. Cl.[6] ..... G08B 13/24

[52] U.S. Cl. ..... 340/551; 340/572; 355/200; 355/201; 355/202; 388/401; 388/462

[58] Field of Search ..... 340/572, 551; 355/201, 200, 202; 388/462, 401

[56] References Cited

U.S. PATENT DOCUMENTS

| | | | |
|---|---|---|---|
| 3,665,449 | 5/1972 | Elder et al. | 340/280 |
| 4,179,212 | 12/1979 | Lahr | 355/202 |
| 4,647,917 | 3/1987 | Anderson, III et al. | 340/572 |
| 4,660,025 | 4/1987 | Humphrey | 340/572 |
| 4,929,928 | 5/1990 | Hultaber | 340/572 |
| 4,940,966 | 7/1990 | Pettigrew et al. | 340/572 |
| 5,017,907 | 5/1991 | Cordery et al. | 340/551 |
| 5,049,856 | 9/1991 | Crossfield | 340/551 |
| 5,083,112 | 1/1992 | Piotrowski et al. | 340/572 |
| 5,299,026 | 3/1994 | Vincett et al. | 358/401 |
| 5,321,412 | 6/1994 | Kopp et al. | 340/572 |
| 5,444,779 | 8/1995 | Daniele | 358/462 |
| 5,530,520 | 6/1996 | Clearwater | 355/201 |

FOREIGN PATENT DOCUMENTS 0 649 074 A1 10/1994 European Pat. Off. .

*Primary Examiner*—Jeffery Hofsass
*Assistant Examiner*—Benjamin C. Lee
*Attorney, Agent, or Firm*—William F. Noval

[57] ABSTRACT

A copyright protection system is provided in which copyrighted articles, such as documents and photos, have associated with the article magnetic material which is detected when the article is copied on a scanner/reproducing machine. The magnetic material may be secured to the article so that it cannot be removed without destroying the article, or the magnetic material may form part of the article. The scanner/reproducing machine is provided with a magnetic detection system for automatically detecting the copyrighted article.

13 Claims, 8 Drawing Sheets

COPYRIGHT PROTECTION FOR PHOTOS AND DOCUMENTS USING MAGNETIC ELEMENTS

FIELD OF THE INVENTION

This invention relates in general to the detection of specific documents in scanning/reproducing equipment and relates more particularly to the detection of copyright protected documents and photos in scanning/reproducing equipment through the use of magnetic detection techniques.

BACKGROUND OF THE INVENTION

Reprographic devices (including digital scanners linked to printers, copiers, and fax machines) can be used to generate copies of documents, including those which are protected by copyright. Equipment exists (such as the KODAK Digital Print Station) which can scan and print professional photographs at a quality level which is comparable to that obtained from reprinting the original negative. Because it is quick and easy, and because of the high quality of the copied image, the volume of such duplications will likely become quite large. A means of detecting copyrighted professional photographs during the reproduction process is needed to enable royalties to be paid to the copyright owner, such as the professional photographer.

Known techniques to provide protection for copyrighted documents have not been entirely successful. EP Application Publ. No. 0 649 074 A1, filed Oct. 18, 1994, inventor Daniele, discloses a method of detecting copyrighted documents which uses a glyph code on the face of the document. The glyph code would have to be placed on the border of the front of the photo, and could detract from the aesthetic appeal of the photo. EP Application Publ. No. 0 581 317 A2, filed Jul. 30, 1993, inventor Powell, discloses a method of embedding a signature within a digital image. This technique requires that the image be digitized, and is not suitable for use with photographic prints from silver halide negatives. U.S. Pat. No. 5,299,026, issued Mar. 29, 1994, inventors Vincett, et al., discloses an apparatus for tracking the reproduction of copyrighted documents, which requires operator input to specify whether the document is protected or not and cannot automatically perform this function.

As disclosed in the following patents, it is also known to provide magnetic markers or tags on library books or unsold merchandise to prevent stealing or pilferage of the marked article. However this technique has not been suggested for use in copyright protection systems. U.S. Pat. No. 5,017,907, issued May 21, 1991, inventors Cordery, et al.; U.S. Pat. No. 4,660,025, issued Apr. 21, 1987, inventor Humphrey; U.S. Pat. No. 3,665,449, issued May 23, 1972, inventors Elder, et al.; and U.S. Pat. No. 5,049,856, issued Sep. 17, 1991, inventor Crossfield.

There is thus a need to provide a copyright protection system for documents and photos which is activated automatically when the article is copied and which does not detract from the quality or aesthetic nature of the copyrighted article.

SUMMARY OF THE INVENTION

According to the present invention, there is provided a solution to the problems and needs mentioned above.

According to a feature of the present invention, a copyright protection system is provided in which copyrighted articles, such as documents and photos, have associated with the article magnetic material which is detected when an attempt is made to copy the article on a scanner/reproducing machine. The magnetic material may be secured to the article so that it cannot be removed without destroying the article, or the magnetic material may form part of the article. The scanner/reproducing machine is provided with a magnetic detection system for automatically detecting the copyrighted article.

The invention has the following advantages.

1. Automatic detection of copyrighted articles such as documents and professional photographs ensures that royalties are collected for the reproduction thereof 2. Using one or more of the magnetic detection arrangements described herein allows the detection to occur without any effect on the front of the article (such as a glyph, bar code, or optical character recognition).

3. Using labels with magnetic material allows the detection techniques to be implemented quickly.

4. The detection methods described herein can be implemented at a small fraction of the total cost of the reproduction system.

5. The magnetic tags do not appreciably increase the cost of the protected articles.

DESCRIPTION OF THE EMBODIMENTS

In general the present invention provides for the automatic detection of copyrighted articles without any effect on the visual appearance of the article when the article is placed in a scanner or other reprographic device. The invention uses a magnetic material which is associated with a copyrighted article and a magnetic detector associated with a scanner or reproduction machine for automatically detecting the magnetic material so as to identify the article as one that is copyrighted and the copying of which entails payment of a royalty to the copyright owner.

Figure 1:
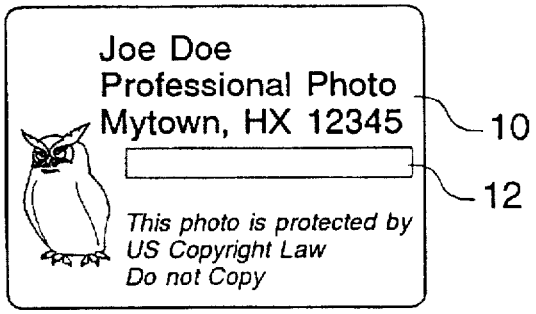
FIGS. 1, 2, and 3 are respectively front, back, and side views of a copyright label according to a feature of the present invention.
Figure 2:
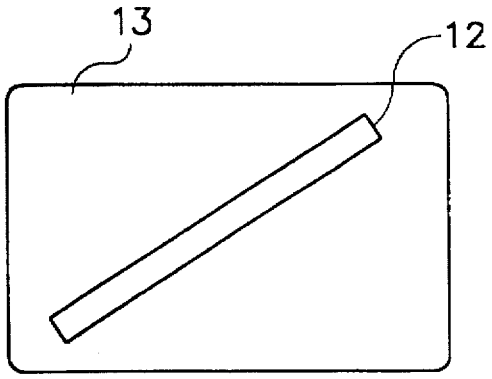
Figure 3:
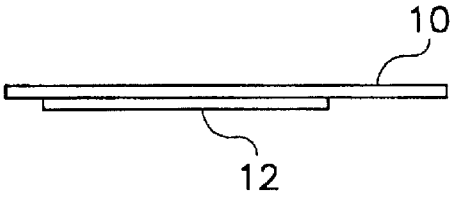
Figure 5:
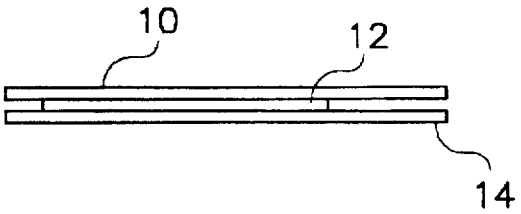
FIGS. 4 and 5 are respectively back and side views of a document incorporating the label of FIGS. 1–3.
Figure 4:
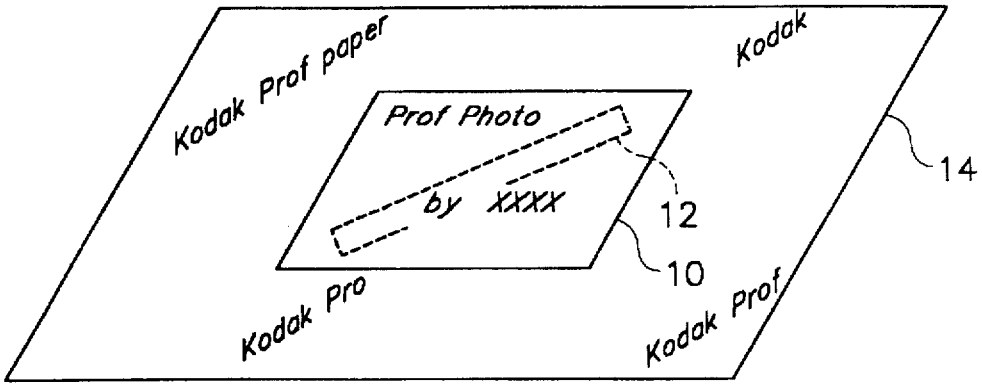

Referring to FIGS. 1–3 there is shown a label 10 which has a magnetic element 12 on the back. The front of the label 10 has printed matter identifying the copyright owner to facilitate distribution of royalties. The back of the label 10 has adhesive 13 (FIG. 2) so that the label can be attached to the back of an article 14, such as a document or a photograph (FIGS. 4, 5). The adhesive is strong enough to prevent removal of the label 10. The magnetic element may be in the form of a thin film, ribbon, wire, printed pattern, or other form. Magnetic element 12 is hidden when it is attached to article 14 (FIG. 5). The magnetic element 12 may also be laminated to label 10.

It is also possible to place magnetic elements directly in the photographic paper or other document, thus eliminating the need for attachment of a separate label to the copyrighted document. For example, the paper may contain magnetic fibers. In such a case, some means must be provided to identify the copyright owner for distribution of royalties, as, for example, printing the copyright owner's name on the back of the article. It is also possible to use magnetic ink to print entire or part of the information on the back of the article.

Figure 6:
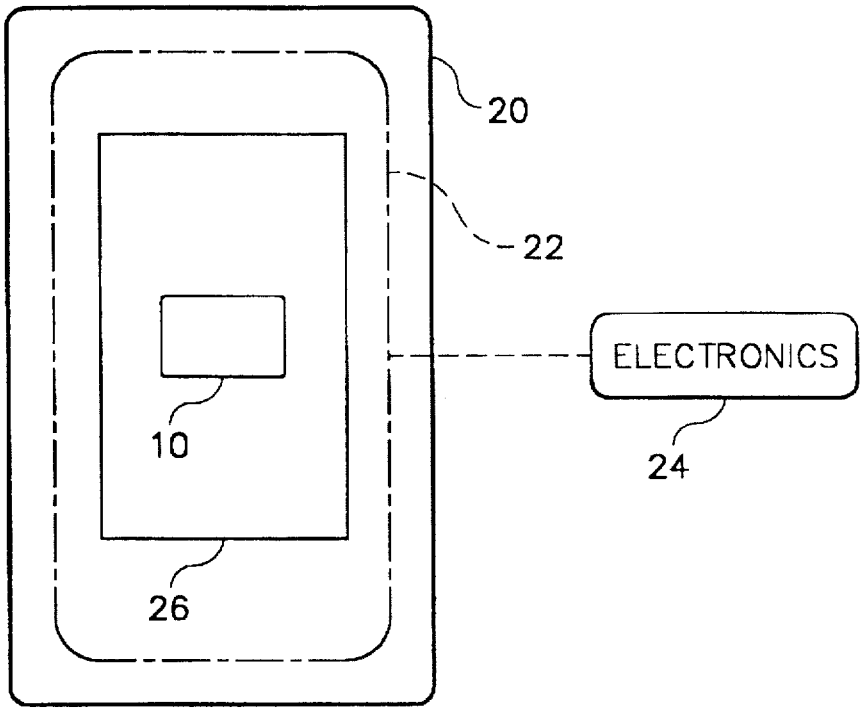
FIG. 6 is a diagrammatic view of a scanner incorporating the system of the present invention.

Described below are several devices for use with a scanner or reproduction machine which automatically detect the magnetic element associated with a copyrighted article to be scanned or copied. As shown in FIG. 6, a scanner 20 is provided with a dual magnetic coil 22 and activation and detecting electronics 24. The dual coil 22 is placed in the scanner cover. When a photograph 26 with a label 10 and magnetic strip 14 is placed in the scanner 20, the change in the magnetic coil response is measured by the electronics 24. This alerts the scanner system that a royalty must be paid to permit continued scanning or reproduction. It will be understood that the coil 22 could also be placed below the platen supporting the photograph 26 or could be laminated onto the platen using transparent materials to form the coil.

Figure 7:
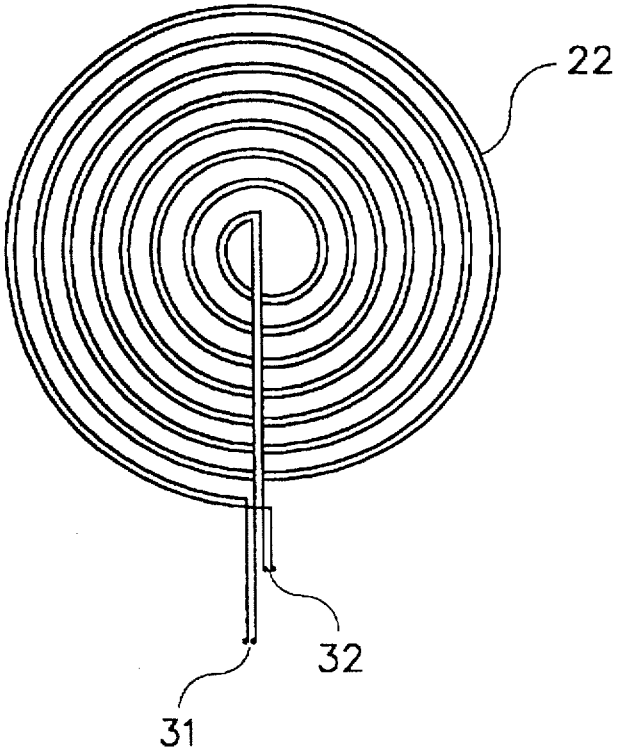
FIG. 7 is a diagrammatic view of a magnetic detector for use in the present invention.
Figure 8:
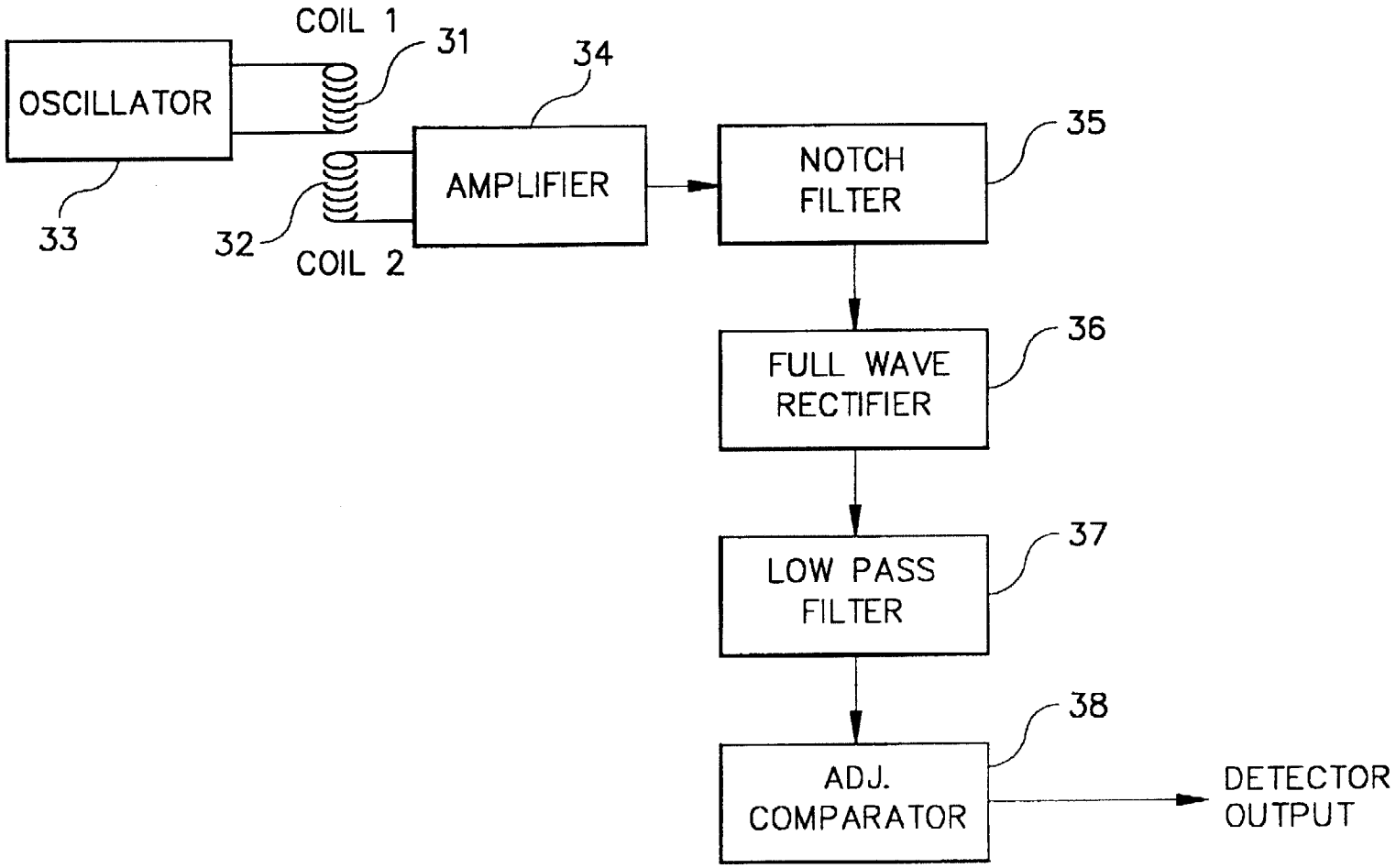
FIG. 8 is a schematic view of a circuit for use with the detector of FIG. 7.

FIG. 7 shows a diagrammatic view of coil 22 which consists of a planar transmitter coil 31 and a planar receiver coil 32 helically wound with coil 31. FIG. 8 is a schematic diagram of a circuit for use with the coil 22. As shown, oscillator 33 drives coil 31 producing an alternating field where the document is placed on the scanner/reproduction machine. Coil 32 receives a signal from coil 31. Amplifier 34 and notch filter 35 remove any signal due to coil 31 and pickup high harmonics from magnetic element 12 if it is present on photograph 26, due to the switching in the alternating magnetic field. Rectifier 36, low pass filter 37, and comparator 38 are used to convert the harmonic signal into a digital output indicating that a copyrighted article has been detected.

Figure 9:
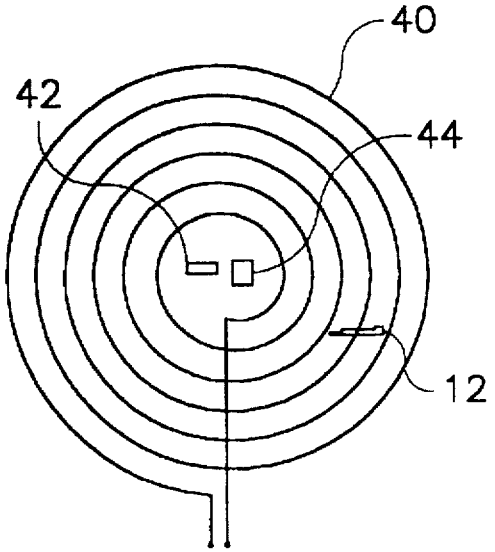
FIG. 9 is a diagrammatic view of a further magnetic detector for use in the present invention.
Figure 10:
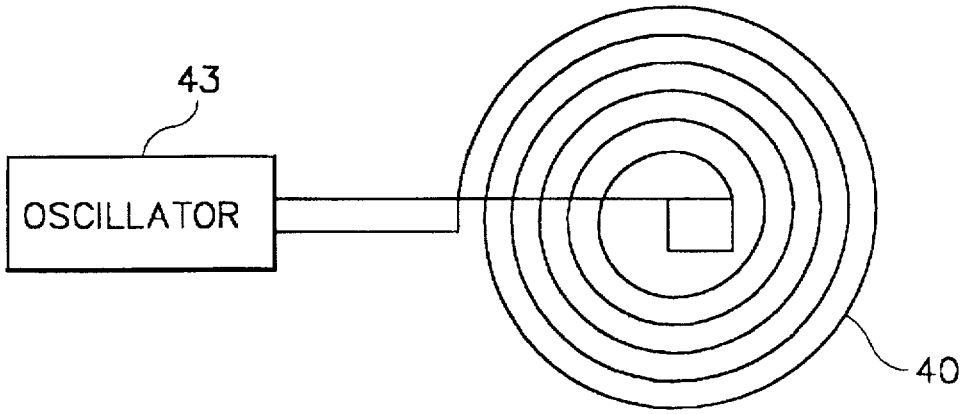
FIGS. 10 and 11 are schematic views respectively of an activating circuit and a detection signal processing circuit for use with the detector of FIG. 9.
Figure 11:
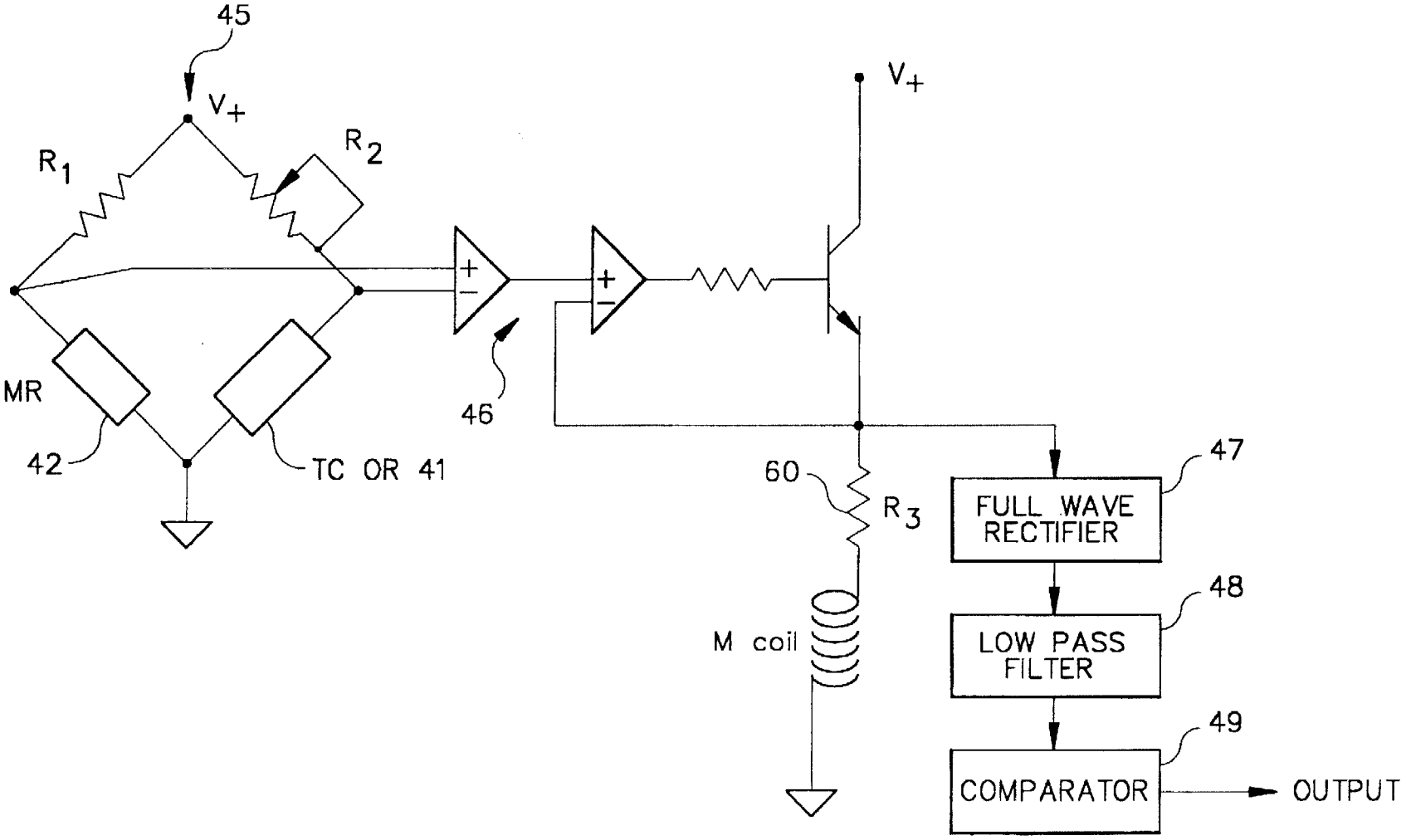

Referring now to FIG. 9 there is shown another embodiment of magnetic detector for use in the present invention. As shown, a single coil 40 is used to magnetize the magnetic element 12. The fringing field from element 12 is detected by magnetic detector 42. A second magnetic detector 44 may be used to measure fields along an axis orthogonal to the sensitive axis of detector 42, to increase the overall sensitivity of the detection for any possible orientation of the label 10. Magnetic detectors 42 and 44 are located at the null point of coil 40. FIGS. 10 and 11 show circuits used with the detector of FIG. 9. FIG. 10 shows an oscillator 43 for supplying an alternating drive current to coil 40. FIG. 11 shows a detecting circuit including bridge 45 which has detectors 42 and/or 44 in arms thereof, differential amplifiers 46, and resistor 60. The signal at resistor 60 is processed by full wave rectifier 47, low pass filter 48, and comparator 49 which function as in the circuit of FIG. 8 to provide an output signal. The circuit drives M coil to offset the field of the element 12 and keep the field on the magnetic detectors 42,44 constant.

Figure 12:
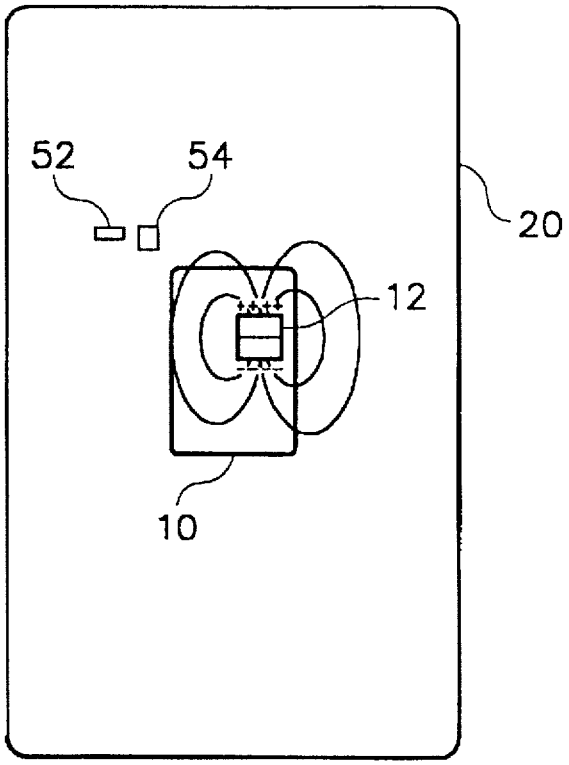
FIG. 12 is a diagrammatic view of another magnetic detector according to the present invention.

Referring now to FIG. 12, there is shown another magnetic detector for use in the present invention. As shown, magnetic element 12 is of barium ferrite or other permanent magnetic material. Element 12 is on document 10. The fringing magnetic field from element 12 is detected by magnetic detector 52 located on the inside lid of scanner 20. A second magnetic detector 54 may be used to measure fields along an axis orthogonal to the sensitive axis of detector 52, to increase the overall sensitivity of the detection for any possible orientation of label 10. Magnetic detectors may be for example magnetoresistive sensors.

Figure 13:
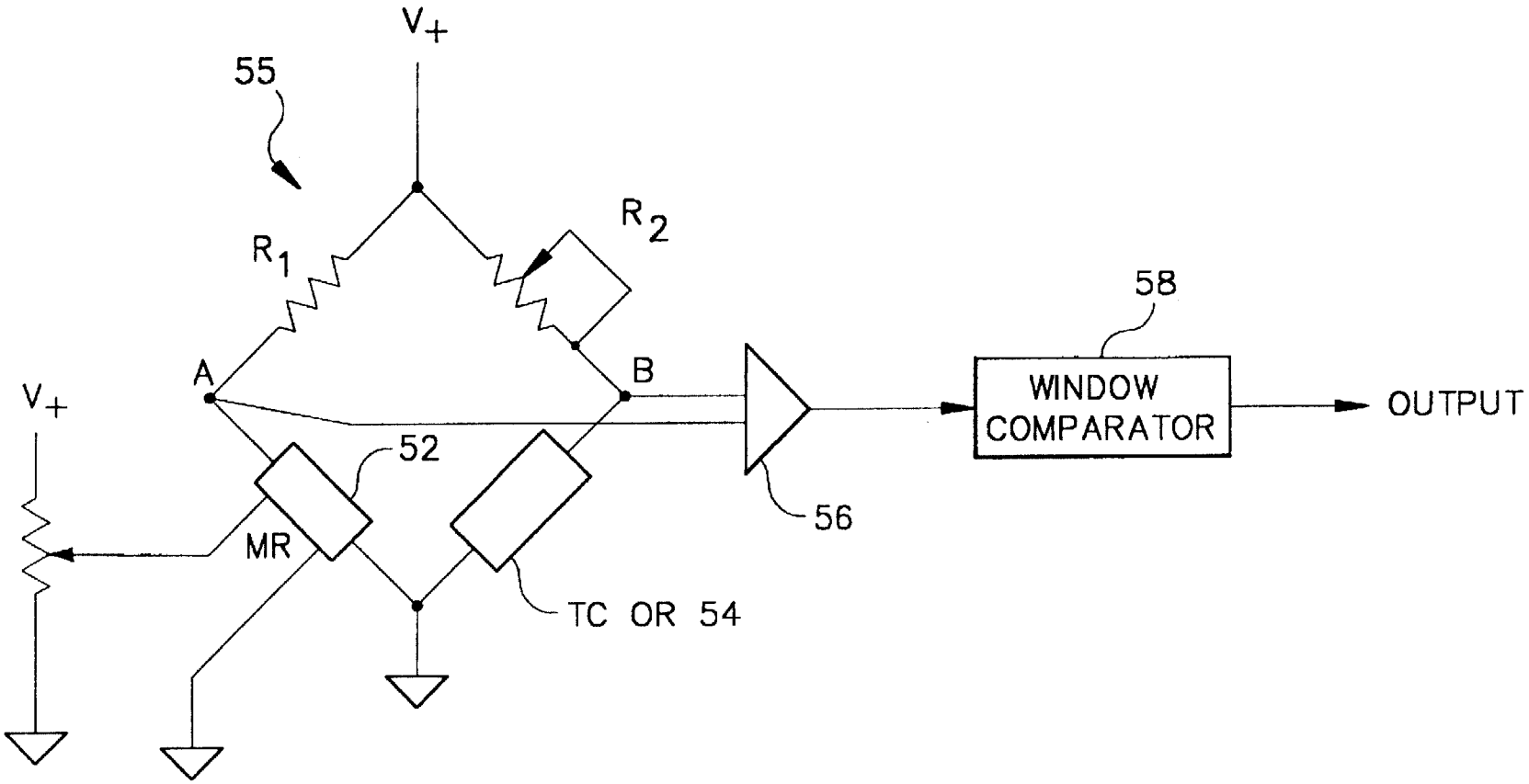
FIG. 13 is a schematic view of a circuit for use with the detector of FIG. 12.

FIG. 13 shows a circuit for use with the detector of FIG. 12. As shown, magnetic detector 52 and/or 54 are in the arms of bridge circuit 55. When the magnetic field from a permanent magnet element 12 is sensed by detectors 52,54, the signal at nodes A and B is compared at comparator 56 and when it exceeds the limit of window comparator 58 a positive output signal is produced. The circuit may also be set up in a feedback mode, such as in the circuit of FIG. 11, to keep the M coil at the correct bias point for the detectors 52,54 regardless of movement of scanner 20 in the earth's magnetic field.

Figure 14:
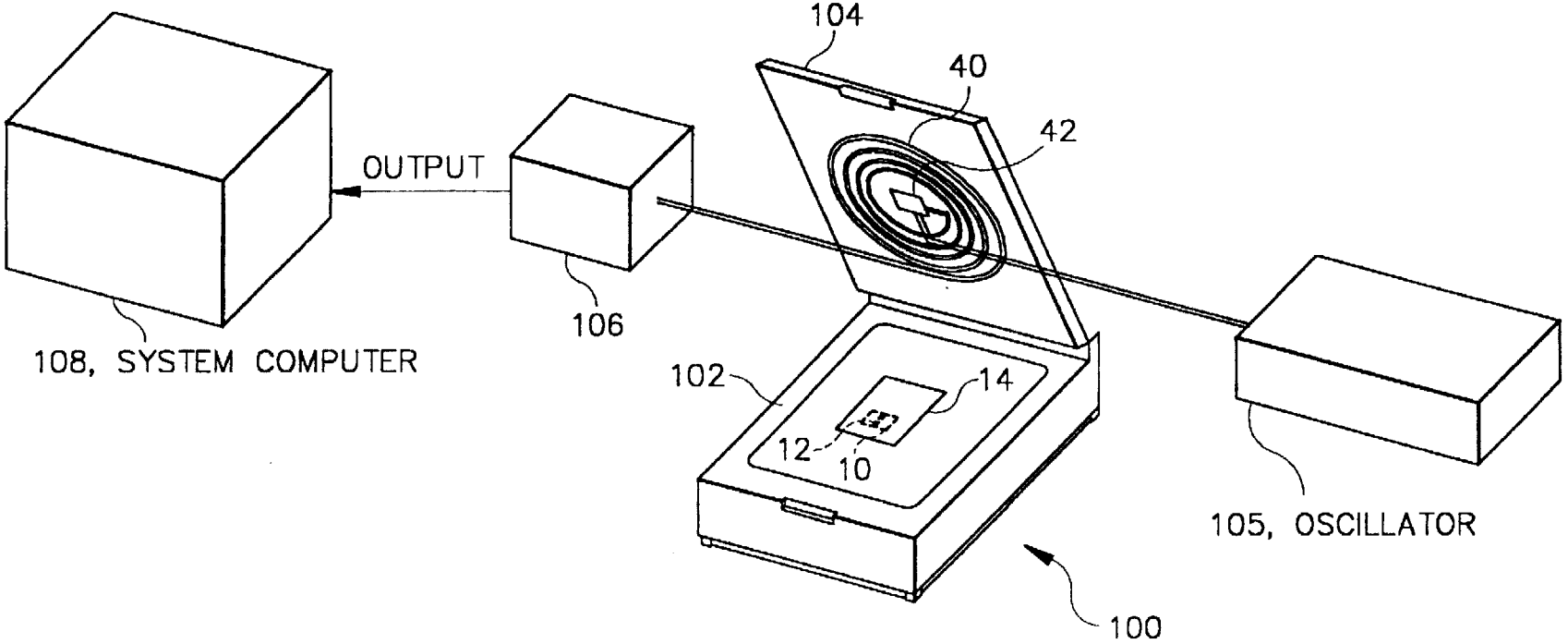
FIG. 14 is a perspective view of a scanner incorporating an embodiment of the present invention.

FIG. 14 shows a scanner 100 having a transparent platen 102 upon which is placed a photo 14 to be scanned. Photo 14 has a copyright owner label 10 with a magnetic element 12. Scanner 10 has a cover 104 with a magnetic coil 40 and magnetic detector 42 therein as shown in FIG. 9. Coil 40 is actuated by oscillator circuit 105. The output of detector 42 is processed by electronics 106 (as in FIG. 11) and the detector output is sent to the scanner computer 108 which sends a message to the customer that the photo cannot be reproduced.

It will be understood that other magnetic elements and magnetic detector configurations may be used and still be within the scope of the present invention. Thus the invention has been disclosed in detail with respect to preferred embodiments thereof, but it will be understood that variations and modifications can be effected within the spirit and scope of the invention.

What is claimed is:

1. A system for the detection of a copyrighted article comprising:

a magnetic element which is permanently associated with a copyrighted article; and a magnetic detector associated with a scanner/reproduction machine which automatically detects the magnetic element when the copyrighted article is located in close proximity to said magnetic detector at the scanner/reproduction machine to scan/reproduce the article and which produces a signal indicative of the copyrighted article.

2. The system of claim 1 wherein said article is a document or photograph and wherein said magnetic element is associated with a face of said article which is not scanned or copied.

3. The system of claim 1 wherein said magnetic element is physically part of said article.

4. The system of claim 1 wherein said magnetic element is of permanent magnet material and wherein said magnetic detector is a magnetic sensor for detecting the field generated by said permanent magnet material.

5. The system of claim 1 wherein said magnetic element is of high permeability nonmagnetostrictive material.

6. The system of claim 1 wherein said magnetic element is part of a label which is permanently adhered to said article and which has visual information identifying the copyright owner.

7. The system of claim 6 wherein said magnetic element is located such that it is invisible when said label is adhered to said article.

8. The system of claim 1 wherein said magnetic detector includes a transmitting coil and a receiving coil in close proximity to a copyrighted article to be detected and associated detection circuitry for detecting said magnetic element wherein said coils are helically wound with respect to each other.

9. The system of claim 8 wherein said coils are positioned with a cover which is brought into contact with a copyrighted article.

10. The system of claim 8 wherein said coils are placed below or as part of a platen supporting a copyrighted article.

11. The system of claim 1 wherein said magnetic detector includes a helical transmitting coil and a magnetic sensor located at the center of said coil for detecting said magnetic element, wherein said coil and said scanner are in close proximity to a copyrighted article to be detected.

12. The system of claim 11 wherein said detector is a magnetoresistive sensor.

13. The system of claim 11, including another magnetic sensor located at the null of said coil, wherein said magnetic sensor and said another magnetic sensor have axes of sensitivity which are orthogonal to each other.

* * * * *